US006522294B2

(12) United States Patent
Vail et al.

(10) Patent No.: US 6,522,294 B2
(45) Date of Patent: Feb. 18, 2003

(54) PHASED ARRAY ANTENNA PROVIDING RAPID BEAM SHAPING AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/991,547

(22) Filed: Nov. 9, 2001

(65) Prior Publication Data

US 2002/0070895 A1 Jun. 13, 2002

Related U.S. Application Data

(60) Provisional application No. 60/255,007, filed on Dec. 12, 2000.

(51) Int. Cl.[7] ..... H01Q 3/22; H01Q 3/24; H01Q 3/26

(52) U.S. Cl. ..... 342/372; 342/157; 342/158

(58) Field of Search ..... 342/372, 368, 342/157, 158

(56) References Cited

U.S. PATENT DOCUMENTS

| | | | | |
|---|---|---|---|---|
| 4,931,803 | A | 6/1990 | Shimko | 342/371 |
| 4,980,691 | A | 12/1990 | Rigg et al. | 342/372 |
| 4,994,814 | A | 2/1991 | Aoki et al. | 342/372 |
| 4,996,532 | A | 2/1991 | Kirimoto et al. | 342/81 |
| 5,008,680 | A | 4/1991 | Willey et al. | 342/372 |
| 5,027,126 | A | 6/1991 | Basehgi et al. | 342/372 |
| 5,072,228 | A | 12/1991 | Kuwahara | 342/360 |
| 5,225,841 | A | 7/1993 | Krikorian et al. | 342/204 |
| 5,231,405 | A | 7/1993 | Riza | 342/375 |
| 5,243,274 | A | 9/1993 | Kelsey et al. | 324/158 R |
| 5,283,587 | A | 2/1994 | Hirshfield et al. | 342/372 |
| 5,353,031 | A | 10/1994 | Rathi | 342/372 |
| 5,493,255 | A | 2/1996 | Murtojarvi | 330/296 |
| 5,559,519 | A | 9/1996 | Fenner | 342/174 |
| 5,592,179 | A | 1/1997 | Windyka | 342/372 |
| 5,655,841 | A | 8/1997 | Storm | 374/183 |
| 5,680,141 | A | 10/1997 | Didomenico et al. | 342/372 |
| 5,771,016 | A | 6/1998 | Mullins et al. | 342/372 |
| 5,938,779 | A | 8/1999 | Preston | 714/718 |
| 5,990,830 | A | 11/1999 | Vail et al. | 342/368 |
| 5,995,740 | A | 11/1999 | Johnson | 395/500.41 |
| 5,999,990 | A | 12/1999 | Sharrit et al. | 718/8 |
| 6,011,512 | A | 1/2000 | Cohen | 342/372 |
| 6,023,742 | A | 2/2000 | Ebeling et al. | 710/107 |
| 6,157,681 | A | 12/2000 | Daniel et al. | 375/298 |
| 6,163,220 | A | 12/2000 | Schellenberg | 330/295 |
| 6,172,642 | B1 | 1/2001 | DiDomenico et al. | 342/368 |

*Primary Examiner*—Theodore M. Blum
(74) *Attorney, Agent, or Firm*—Allen, Dyer, Doppelt, Milbrath & Gilchrist, P.A.

(57) ABSTRACT

A phased array antenna may include a substrate, a plurality of phased array antenna elements carried by the substrate, and a central controller for providing beam steering commands and beam shaping commands. Furthermore, the phased array antenna may also include a plurality of element controllers connected to the phased array antenna elements and the central controller. Each element controller may store at least one position related value based upon physical positioning of the associated phased array antenna element on the substrate, and determine a beam shaping offset based upon the stored at least one position related value and a received beam shaping command from the central controller. Each element controller may also determine at least one phased array antenna element control value based upon a received beam steering command and the beam shaping offset.

34 Claims, 3 Drawing Sheets

PHASED ARRAY ANTENNA PROVIDING RAPID BEAM SHAPING AND RELATED METHODS

RELATED APPLICATION

This application is based upon prior filed provisional application Ser. No. 60/255,007 filed Dec. 12, 2000, the entire subject matter of which is incorporated herein by reference in its entirety.

FIELD OF THE INVENTION

The present invention relates to the field of communications, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission and/or reception pattern of the communications signals in response to the signal environment to improve performance characteristics.

For example, each antenna element typically has a respective phase shifter and/or attenuator associated therewith. The phase shifters/attenuators may be controlled by a central controller, for example, to adjust respective phases/attenuations of the antenna elements across the array. Thus, it is possible to perform beam shaping or to adjust beam width (i.e., ("spoiling") to receive or transmit over a wider area.

To accomplish such beam shaping or spoiling for example, the central controller of a typical prior art phased array antenna may compute (or look up from a table) a new phase shifter and/or attenuator control value for each antenna elements for each successive beam shape to be implemented across the array. These values would then be communicated to the respective antenna elements to implement the new beam shape. Unfortunately, this approach generally requires that the central controller must look up element specific position data for each element and calculate the spoiling data for each element, which can be a relatively slow process. The central controller would then transmit the corresponding data to each element. As a result, the resulting delays of implementing a new beam shape may cause appreciable and undesirable signal outages, for example.

An example of a prior art control architecture for a phased array antenna is disclosed in U.S. Pat. No. 4,980,691 to Rigg et al. This patent is directed to a distributed parallel processing architecture for electronically steerable multi-element radio frequency (RF) antennas. The array is subdivided into several sub-arrays, where each sub-array has more than one RF radiating element, and a phase shift interface electronics ("PIE") device for each sub-array. Parameters specific to the RF elements within each sub-array are preloaded into the corresponding PIE. Pointing angle and rotational orientation parameters are broadcast to the PIEs which then calculate, in parallel and in a distributed processing manner, the phase shifts associated with the various elements in the corresponding sub-arrays.

While such prior art approaches may provide some improvement in the time required to change a beam shape, they may still be limited in their ability to provide sufficiently small beam shape changing times in certain applications. That is, while all of the spoiling data is not calculated by the central controller for each antenna element, each of the sub-array phase shift interfaces must still perform such calculations for all of its respective sub-array antenna elements. Thus, beam shape changing times may still be appreciably large when many antenna elements are included within a sub-array. This problem may be further compounded when relatively complex beam shapes are being implemented, which may require a fairly large amount of computation for each antenna element.

SUMMARY OF THE INVENTION

In view of the foregoing background, it is therefore an object of the present invention to provide a phased array antenna and related method which provides for relatively rapid beam shape changing.

This and other objects, features, and advantages in accordance with the present invention are provided by a phased array antenna which may include a substrate, a plurality of phased array antenna elements carried by the substrate, and a central controller for providing beam steering commands and beam shaping commands. Furthermore, the phased array antenna may also include a plurality of element controllers connected to the phased array antenna elements and the central controller. Each element controller may store at least one position related value based upon physical positioning of the associated phased array antenna element on the substrate, and determine a beam shaping offset based upon the stored at least one position related value and a received beam shaping command from the central controller. Each element controller may also determine at least one phased array antenna element control value based upon a received beam steering command and the beam shaping offset.

More particularly, the plurality of phased array elements may be arranged in a predetermined pattern about a phase center, and the at least one position related value may be based upon physical positioning relative to the phase center. The central controller may provide common beam shaping commands to all of the element controllers, each of which may include a plurality of common beam shaping coefficients. Further, the at least one position related value may include a plurality of position related coefficients, and each element controller may determine the beam shaping offset based upon multiplications of the position related coefficients and the common beam shaping coefficients. Additionally, each element controller may further perform at least one accumulation.

Considered in other terms, each element controller may store, as the at least one position related value, a plurality of beam shaping offsets for respective different beam shapes. Moreover, each element controller may determine, as the beam shaping offset, one of the plurality of stored beam shaping offsets based upon receiving a corresponding beam shaping command therefor.

The central controller may provide the at least one position related value for storing in each element controller. The central controller may also determine the at least one position related value for storing in each element controller. Each element controller may include at least one register for storing the at least one position related value. In addition, the at least one phased array antenna element control value may include at least one of a phase and attenuation value.

A method aspect of the invention is for operating a phased array antenna such as that described above. The method may include storing, at each element controller, at least one position related value based upon physical positioning of the associated phased array antenna element on the substrate. Furthermore, at each element controller a beam shaping offset may be determined based upon the stored at least one position related value and a received beam shaping command from the central controller. The method may also include determining, at each element controller, at least one phased array antenna element control value based upon a received beam steering command and the beam shaping offset.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
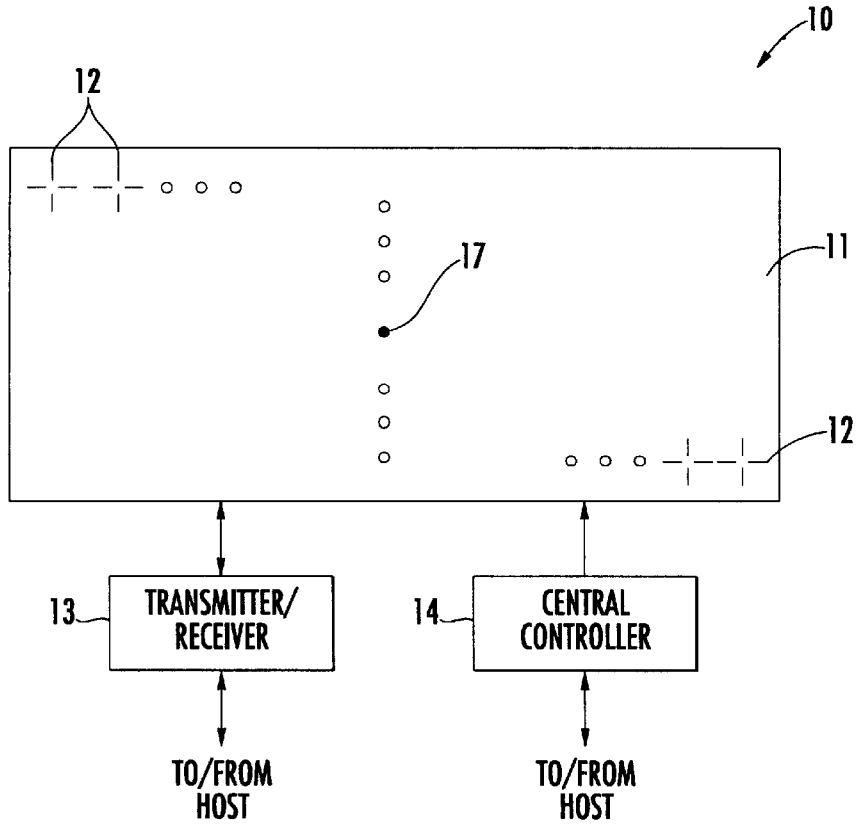
FIG. 1 is a schematic block diagram of a phased array antenna according to the present invention.

Referring initially to FIG. 1, a phased array antenna 10 according to the invention includes a substrate 11 and a plurality of phased array antenna elements 12 carried thereby. As used herein, "substrate" refers to any surface, mechanized structure, etc., which is suitable for carrying a phased array antenna element, as will be appreciated by those of skill in the art. The phased array antenna 10 may also include a transmitter and/or receiver 13 for sending and receiving communications signals (e.g., microwave or RF signals) via the antenna elements 12, and a central controller 14. The central controller may provide both beam steering and beam shaping commands, as will be described further below. The transmitter receiver 13 and central controller 14 may also be connected to a host (not shown), such as a microprocessor, for processing the signals to be transmitted or received and for providing beam shaping/steering data to the central controller, for example. The phased array antenna 10 may be used for ground, airborne, or spaceborne applications, as will be readily understood by those skilled in the art.

Figure 2:
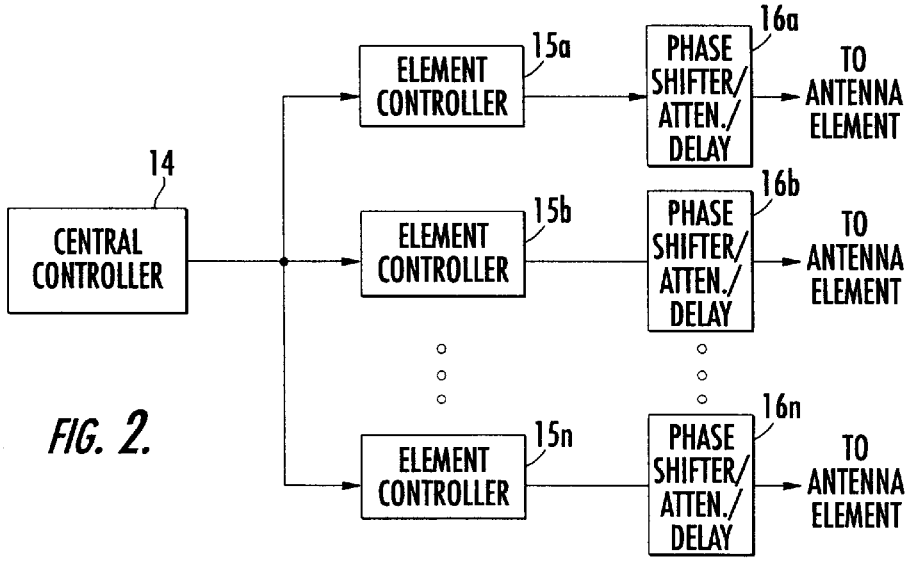
FIG. 2 is a schematic block diagram illustrating the central controller and element controllers of the phased array antenna of FIG. 1.
Figure 3:
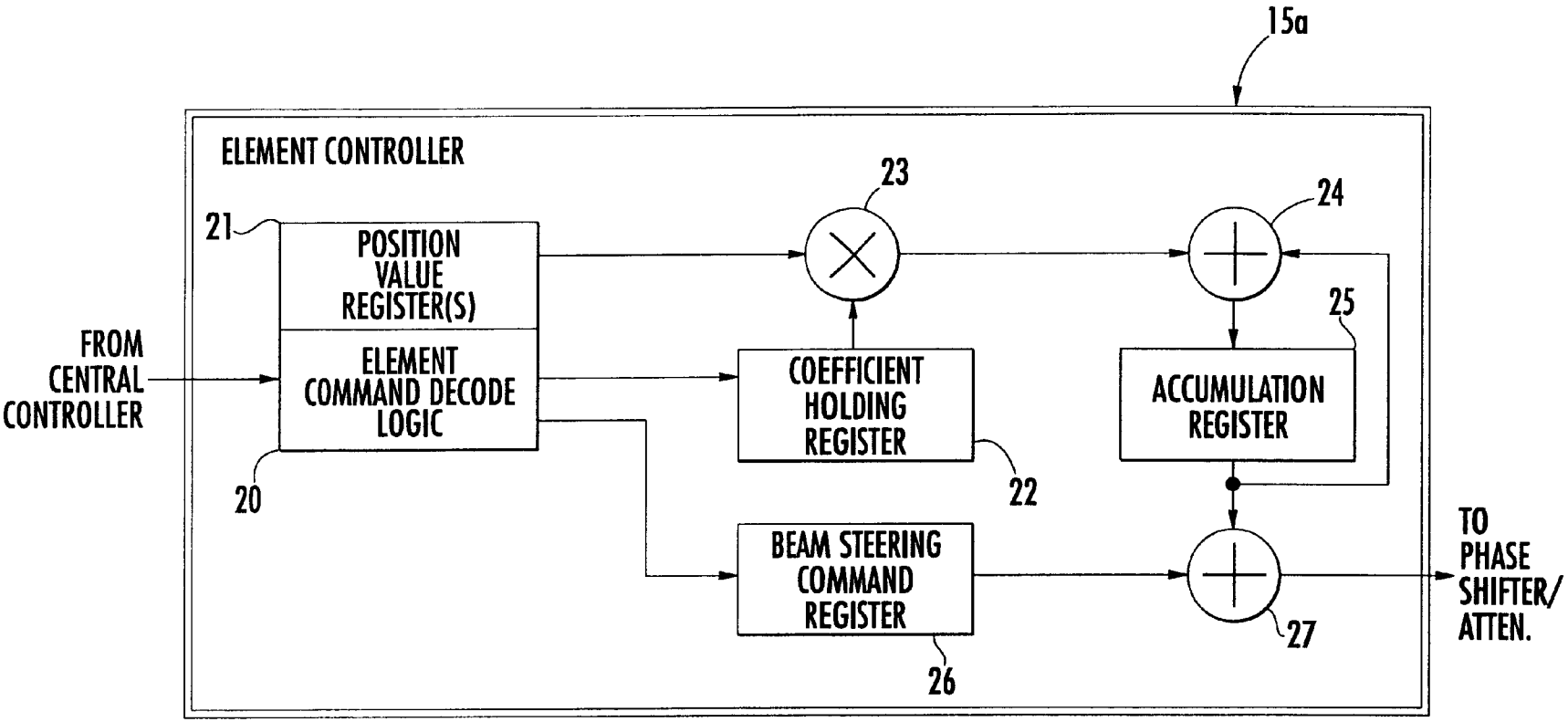
FIG. 3 is more detailed schematic block diagram of an embodiment of the element controllers of FIG. 2.

Turning now to FIGS. 2 and 3, the phased array antenna 10 further includes a plurality of antenna element controllers 15*a*–15*n* connected to the phased array antenna elements 12 and the central controller 14. As shown in FIG. 2, there is a respective element controller 15*a*–15*n* for each phased array antenna element 12, but a single element controller may be used for more than one phased array antenna element in some embodiments, as will be appreciated by those of skill in the art. Each element controller 15*a*–15*n* may further have one or more phase shifters, attenuators, and/or delay elements 16*a*–16*n* associated therewith for its respective antenna element 12, as will be appreciated by those of skill in the art.

According to the invention, each element controller 15*a*–15*n* may store at least one position related value based upon physical positioning of its associated phased array antenna element 12 on the substrate 11. More particularly, the plurality of phased array elements 12 may be controlled to define a phase center 17 (FIG. 1). The phase center 17 is a preferably defined logical "pivot point" of the array to be used as a steering reference. The phase center 17 does not have to be in the physical center of the array, but, the phase center does determine how the physical position values are to be calculated. That is, the position related values may thus be based upon physical positioning relative to the phase center 17, and these values (or data used to determine these values) may be stored in a non-volatile memory (e.g., a read only memory) of the central controller 14, for example. This memory may be programmed during manufacture of the phased array antenna 10.

As illustratively shown in FIG. 3, each element controller 15*a*–15*n* may include element command decode logic 20 which receives the position related values from the central controller 14. Further, each element controller 15*a*–15*n* may include one or more position value registers 21 for storing the position related values. The position related values may be downloaded from the central controller 14 upon initialization of the phased array antenna 10, for example. Of course, in some embodiments each element controller 15*a*–15*n* may include a non-volatile memory for storing its respective position related values so that these values do no have to be downloaded from the central controller 14.

Each element controller 15*a*–15*n* determines a beam shaping offset based upon its stored position related values and a received beam shaping command, which may be provided by the central controller 14. Since each element controller 15*a*–15*n* stores its respective position related values, the central controller 14 may advantageously provide common beam shaping commands to all of the element controllers for a desired beam shaping. The common beam shaping commands may include a plurality of common beam shaping coefficients, which may be stored in a coefficient holding register 22, for example, as illustratively shown in FIG. 3. The coefficient holding register 22 may be used to temporarily hold the coefficient value as it is sent by the host until the multiply/accumulated operation with the coefficient is complete. Then, the next coefficient may be similarly processed.

Specifically, the position related values may be position related coefficients, and each element controller 15*a*–15*n* may determine the beam shaping offset based upon multiplications of the position related coefficients and the common beam shaping coefficients, as illustratively shown with the multiplication module 23. Additionally, at least one accumulation may be performed by each element controller 15 on the resulting products output by the multiplication module 23. As illustratively shown, the accumulation operation may be performed by an addition module 24 and an accumulation register 25, for example.

Each element controller 15 may also determine at least one phased array antenna element control value based upon a beam steering command received from the central controller 14 and the beam shaping offset output by the accumulation register 25. For example, the beam steering command may include uncompensated phase and temperature offset values which may be stored in a beam steer command register 26. The output from the beam steering command register 26 is added to the beam shaping offset output by the accumulation register 25 via an adder module 27 to provide the element control values for a respective phase shifter/attenuator 16. Of course, the element control values may include phase and/or attenuation values. The determination of the element control values will be further understood with reference to the following example.

EXAMPLE

For purposes of the following example, it will be assumed that each element controller 15*a*–15*n* includes three position value registers 21, each of which is for storing a respective position related coefficient R0, R1, R2. Again, each set of position related coefficients R0–R2 is specific to a respective element controller 15*a*–15*n* based upon its physical positioning relative to the phase center 17. In this example, the values of the coefficients R0–R2 are as follows: R0 is the square of a normalized horizontal distance from the phase center 17 to a respective element controller 15*a*–15*n*; R1 is the square of a normalized vertical distance from the phase center to the element controller; and R2 is the product of the normalized horizontal distance and the normalized vertical distance.

Further, it will also be assumed that the central controller 14 provides a set of three common beam shaping coefficients A0–A2 to all of the element controllers 15*a*–15*n*. Again, these beam shaping coefficients may relate to uncompensated phase and temperature values, for example, and may be serially broadcast to each of the element controllers 15*a*–15*n*. Accordingly, it will be appreciated based upon the above description that the element control values for each element controller 15 will be determined based upon the following algorithm:

$$\text{Spoil offset}=(A0\cdot R0)+(A1\cdot R1)+(A2\cdot R2). \quad (1)$$

Depending on the values of A0–A2, and the basic characteristics of the array, this algorithm provides a variable beam shape, as will also be appreciated by those of skill in the art. Of course, numerous other beam shapes may also be used in accordance with the present invention. For example, more (or fewer) position value registers 21 along with more (or fewer) position related coefficients and beam shaping coefficients may be used to implement more complex cubic or quartic spoiling functions. Operations other than multiplication and addition may also be implemented.

It will therefore be appreciated that the phased array antenna 10 according to the present invention may be used to provide rapid beam shaping across the antenna array. This is because neither the central controller 14 nor sub-array controllers, which may be used in some embodiments, have to perform look-up and calculation operations for a large number of antenna elements 12, as in the prior art. The processing requirements of the central controller 14 may also be further reduced in that only common beam steering coefficients need to be calculated rather than element specific coefficients.

Even further advantages may be realized according to an alternate embodiment of the present invention in which each element controller 15*a*–15*n* may store, as the at least one position related value, a plurality of beam shaping offsets for respective different beam shapes. Thus, each element controller 15*a*–15*n* may determine, as the beam shaping offset, one of the plurality of stored beam shaping offsets based upon receiving a corresponding beam shaping command therefor from the central controller 14. In this embodiment, the multiplication module 23, coefficient holding register 22, addition module 24, and accumulation register 25 may be omitted from the element controller 15. In some embodiments, "R" registers may be used to store normalized horizontal and vertical distances from the phase center 17 so that distributed beam steer calculations can be done if the central controller 14 transmits coefficients which are the phase gradient values, as will be appreciated by those of skill in the art.

Thus, according to this embodiment, beam shapes can essentially be implemented in real time. These beams shapes may include complex beam shapes such as ovals with multiple peaks, for example, as well as numerous other beam shapes. Of course, it will be appreciated that the number of beam shapes that may be implemented will depend upon the quantity and precision of the coefficients and of position value registers 21 used. Moreover, a combination of the above-described embodiments may also be implemented in some applications, i.e., where some beam shaping offsets are stored before hand and others are calculated by the element controllers 15*a*–15*n* via the multiplication and accumulation circuitry described above.

Figure 4:
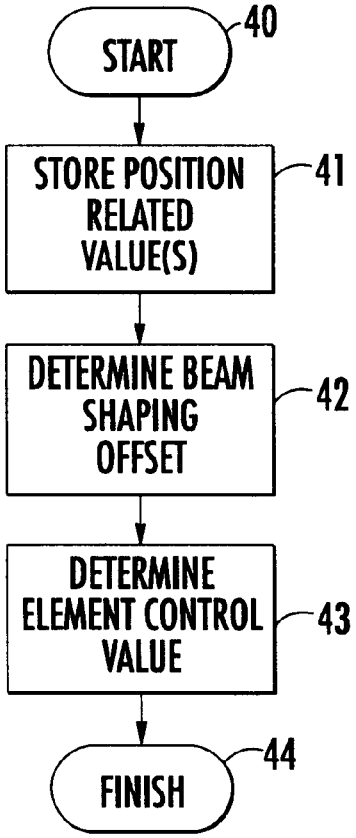
FIG. 4 is a flow diagram illustrating a method according to the present invention.

Referring to FIG. 4, a method aspect of the invention is for operating the phased array antenna 10 is now generally described. The method may begin at Block 40 and include storing, at each element controller 15*a*–15*n*, at least one position related value, i.e., in the position value register(s) 21 (Block 41). Prior to the step illustrated at Block 40, the value of the spoil coefficient may be determined using known mathematical techniques, as will be appreciated by those of skill in the art. Again, the position related value or values are based upon physical positioning of the associated phased array antenna element 12 on the substrate 11.

Furthermore, at each element controller 15*a*–15*n* a beam shaping offset may be determined, at Block 42, based upon the stored position related value and a received beam shaping command from the central controller 14, as previously described above. The method may also include determining (Block 43), at each element controller 15*a*–15*n*, at least one phased array antenna element control value based upon a received beam steering command and the beam shaping offset, also described above, thus concluding the method (Block 44).

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and a plurality of phased array antenna elements carried by said substrate;

a central controller for providing beam steering commands and beam shaping commands; and a plurality of element controllers connected to said phased array antenna elements and said central controller, each element controller storing at least one position related value based upon physical positioning of the associated phased array antenna element on said substrate, determining a beam shaping offset based upon the stored at least one position related value and a received beam shaping command from said central controller, and determining at least one phased array antenna element control value based upon a received beam steering command and the beam shaping offset.

2. The phased array antenna according to claim 1 wherein said plurality of phased array elements are arranged in a predetermined pattern about a phase center; and wherein the at least one position related value is based upon physical positioning relative to the phase center.

3. The phased array antenna according to claim 1 wherein said central controller provides common beam shaping commands to all of said element controllers.

4. The phased array antenna according to claim 3 wherein each common beam shaping command comprises a plurality of common beam shaping coefficients; wherein the at least one position related value comprises a plurality of position related coefficients; and wherein each element controller determines the beam shaping offset based upon multiplications of the position related coefficients and the common beam shaping coefficients.

5. The phased array antenna according to claim 4 wherein each element controller further performs at least one accumulation.

6. The phased array antenna according to claim 1 wherein each element controller stores as the at least one position related value a plurality of beam shaping offsets for respective different beam shapes; and wherein each element controller determines as the beam shaping offset one of the plurality of stored beam shaping offsets based upon receiving a corresponding beam shaping command therefor.

7. The phased array antenna according to claim 1 wherein said central controller provides the at least one position related value for storing in each element controller.

8. The phased array antenna according to claim 1 wherein said central controller determines the at least one position related value for storing in each element controller.

9. The phased array antenna according to claim 1 wherein each element controller comprises at least one register for storing the at least one position related value.

10. The phased array antenna according to claim 1 wherein the at least one phased array antenna element control value comprises at least one of a phase and attenuation value.

11. A phased array antenna comprising:

a substrate and a plurality of phased array antenna elements carried by said substrate;

a central controller for providing beam steering commands and common beam shaping commands, each common beam shaping command comprising a plurality of common beam shaping coefficients; and a plurality of element controllers connected to said phased array antenna elements and said central controller, each element controller storing a plurality of position related coefficients based upon physical positioning of the associated phased array antenna element on said substrate, determining a beam shaping offset based upon multiplication of the position related coefficients and received common beam shaping coefficients from said central controller, and determining at least one phased array antenna element control value based upon a received beam steering command and the beam shaping offset.

12. The phased array antenna according to claim 11 wherein said plurality of phased array elements are arranged in a predetermined pattern about a phase center; and wherein the position related coefficients are based upon physical positioning relative to the phase center.

13. The phased array antenna according to claim 11 wherein each element controller further performs at least one accumulation.

14. The phased array antenna according to claim 11 wherein said central controller provides the plurality of position related coefficients for storing in each element controller.

15. The phased array antenna according to claim 11 wherein said central controller determines the plurality of position related coefficients for storing in each element controller.

16. The phased array antenna according to claim 11 wherein each element controller comprises a plurality of registers for storing the plurality of position related coefficients.

17. The phased array antenna according to claim 11 wherein the at least one phased array antenna element control value comprises at least one of a phase and attenuation value.

18. A phased array antenna comprising:

a substrate and a plurality of phased array antenna elements carried by said substrate;

a central controller for providing beam steering commands and beam shaping commands; and a plurality of element controllers connected to said phased array antenna elements and said central controller, each element controller storing a plurality of beam shaping offsets for respective different beam shapes and based upon physical positioning of the associated phased array antenna element on said substrate, determining a selected beam shaping offset based upon the stored plurality of beam shaping offsets and a received beam shaping command from said central controller, and determining at least one phased array antenna element control value based upon a received beam steering command and the selected beam shaping offset.

19. The phased array antenna according to claim 11 wherein said plurality of phased array elements are arranged in a predetermined pattern about a phase center; and wherein the plurality of beam shaping offsets are based upon physical positioning relative to the phase center.

20. The phased array antenna according to claim 11 wherein said central controller provides common beam shaping commands to all of said element controllers.

21. The phased array antenna according to claim 11 wherein said central controller provides the plurality of beam shaping offsets for storing in each element controller.

22. The phased array antenna according to claim 11 wherein said central controller determines the plurality of beam shaping offsets for storing in each element controller.

23. The phased array antenna according to claim 11 wherein each element controller comprises a plurality of registers for storing the plurality of beam shaping offsets.

24. The phased array antenna according to claim 11 wherein the at least one phased array antenna element control value comprises at least one of a phase and attenuation value.

25. A method for operating a phased array antenna of a type comprising a substrate and a plurality of phased array antenna elements carried by the substrate, a central controller for providing beam steering commands and beam shaping commands, and a plurality of element controllers connected to the phased array antenna elements and the central controller, the method comprising:

storing, at each element controller, at least one position related value based upon physical positioning of the associated phased array antenna element on the substrate;

determining, at each element controller, a beam shaping offset based upon the stored at least one position related value and a received beam shaping command from the central controller; and determining, at each element controller, at least one phased array antenna element control value based upon a received beam steering command and the beam shaping offset.

26. The method according to claim 25 wherein the plurality of phased array elements are arranged in a predetermined pattern about a phase center; and wherein the at least one position related value is based upon physical positioning relative to the phase center.

27. The method according to claim 25 further comprising using the central controller to provide common beam shaping commands to all of the element controllers.

28. The method according to claim 27 wherein each common beam shaping command comprises a plurality of common beam shaping coefficients; wherein the at least one position related value comprises a plurality of position related coefficients; and wherein determining, at each element controller, the beam offset comprises determining the beam shaping offset based upon multiplications between the position related coefficients and the common beam shaping coefficients.

29. The method according to claim 28 wherein determining, at each element controller, the beam shaping offset further comprises determining the beam shaping offset based upon at least one accumulation.

30. The method according to claim 25 wherein storing, at each element controller, the at least one position related value comprises storing a plurality of beam shaping offsets for respective different beam shapes; and wherein determining, at each element controller, the beam shaping offset comprises determining the beam shaping offset based upon receiving a corresponding beam shaping command therefor.

31. The method according to claim 25 wherein the central controller provides the at least one position related value for storing in each element controller.

32. The method according to claim 25 wherein the central controller determines the at least one position related value for storing in each element controller.

33. The method according to claim 25 wherein each element controller comprises at least one register for storing the at least one position related value.

34. The method according to claim 25 wherein the at least one phased array antenna element control value comprises at least one of a phase and attenuation value.

* * * * *

UNITED STATES PATENT AND TRADEMARK OFFICE

CERTIFICATE OF CORRECTION

PATENT NO. : 6,522,294 B2 
DATED : February 18, 2003
INVENTOR(S) : David Kenyon Vail et al.

It is certified that error appears in the above-identified patent and that said Letters Patent is hereby corrected as shown below:

Column 4,
Line 31, delete “do no” insert -- do not --

Column 8,
Lines 37, 42, 45, 48, 51 and 54, delete “Claim 11” insert -- Claim 18 --

Signed and Sealed this

Fifth Day of August, 2003

JAMES E. ROGAN
*Director of the United States Patent and Trademark Office*